US005620309A

United States Patent [19]

Todden et al.

[11] Patent Number: 5,620,309

[45] Date of Patent: Apr. 15, 1997

[54] FLUID PUMP PRIMING SYSTEM

[76] Inventors: Terry J. Todden; Richard A. Thornberry, both of 15442 Vintage St., Mission Hills, Calif. 91345

[21] Appl. No.: 380,021

[22] Filed: Jan. 27, 1995

[51] Int. Cl.[6] ..... F04B 23/10; F04F 10/00

[52] U.S. Cl. ..... 417/199.2; 137/148

[58] Field of Search ..... 417/205, 199.2, 417/425, 423.1; 137/148

[56] References Cited

U.S. PATENT DOCUMENTS

| | | | |
|---|---|---|---|
| 2,401 | 10/1841 | Johnson | 137/142 |
| 111,026 | 1/1871 | Williams . | |
| 994,335 | 6/1911 | Perkins | 417/199.2 |
| 1,139,042 | 5/1915 | Lucke . | |
| 1,528,253 | 3/1925 | Lanser | 417/425 |
| 1,582,399 | 4/1926 | Helander | 137/148 |
| 2,329,495 | 9/1943 | Van Pelt . | |
| 2,472,802 | 6/1949 | Bentley | 417/199.2 |
| 2,830,608 | 4/1958 | Miller | 137/148 |
| 3,750,691 | 8/1973 | Lidolph | 137/142 |
| 4,035,299 | 7/1977 | Vroeginday | 210/169 |
| 4,067,663 | 1/1978 | Brooks et al. | 417/199.2 |

FOREIGN PATENT DOCUMENTS

| | | |
|---|---|---|
| 2457396 | 1/1981 | France . |
| 901638 | 1/1982 | U.S.S.R. . |

*Primary Examiner*—Timothy Thorpe
*Assistant Examiner*—William Wicker

[57] ABSTRACT

An apparatus for priming a non self-priming fluid pump or siphon device includes three components: an outlet valve, priming pump and inlet check valve. All three components are integrated into the casting of the fluid pump or are attached separately to an already existing fluid pump or siphon device. Upon placement of the inlet check valve in a fluid, closing of the outlet valve and activation of the priming pump, positive air pressure and alternately negative air pressure are formed in the fluid pump. This action displaces air through the outlet valve and alternately draws fluid into the fluid pump from the inlet check valve. This action is repeated until the fluid pump is filled. The outlet valve is then opened and the fluid pump activated for use. The inlet check valve retains the fluid within the system regardless of whether the fluid source is depleted or the fluid pump deactivated.

4 Claims, 9 Drawing Sheets

FLUID PUMP PRIMING SYSTEM

FIELD OF THE INVENTION

The invention relates to fluid pumps and particularly to fluid pumps that are not in and of themselves self-priming.

BACKGROUND OF THE INVENTION

Current fluid pump systems come under the classification of either self-priming or non self-priming Self-priming pumps when activated create sufficient suction to draw the fluid and any air surrounding the fluid from the desired fluid source, through the pump and to a specified location. Self priming pumps come in all shapes and sizes and are used extensively throughout the world. However, they have many disadvantages. They contain parts which are subject to wear and need replacement. Flexible rubber impellars or diaphragms are commonly used in these pumps and are subject to constant friction, heat and stress. They must be constantly monitored for the presence of fluid lubrication and cannot be run dry or damage to the moving pans will result. These pumps are also generally heavy, noisy, require considerable power to run and are usually much more expensive than non self-priming pumps.

Alternately, non self-priming pumps consume less power and are more energy efficient. Non self-priming pumps are subject to far less heat and friction therefore adding to their lifespan. They can run dry without damage and in the event of breakdown any replacement pans are inexpensive.

However, the single drawback of the non self-priming pumps is that they must be initially primed with fluid before use or they will not function. This is accomplished either by physically pouring the fluid into the input or output side of the pump or by submersing the pump in the fluid.

The prior art includes the following patents: U.S. Pat. No. 4,035,299 to Vroeginday, U.S. Pat. No. 3,750,691 to Lidolph, U.S. Pat. No. 2,329,495 to Van Pelt, U.S. Pat. No. 1,139,042 to Lucke, U.S. Pat. No. 111,026 to Williams, U.S. Pat. No. 2,401 to Johnson, FR. Pat. No. 2457396 to Materiel Telephonique and SU Pat. No. 901,638 to Fire Mach, Cons. Bur. These references disclose various pump styles and priming systems. However, the above numerated problems are not solved by the prior an so that a simple and practical priming system for use with inexpensive low energy pumps is needed to solve these problems.

SUMMARY OF THE INVENTION

Accordingly, it is the object of the invention to overcome the problems and shortcomings associated with the present day self-priming and non self-priming fluid pumps. The fluid pump priming system according to the present invention is simple and relatively inexpensive. It consists of three essential components; a fluid outlet valve, a fluid priming pump and a fluid inlet check valve.

All three are integrated into the casting of the fluid pump or are attached separately to an already existing fluid pump. Operation is simple. The inlet check valve attached to the fluid pump is placed into the fluid source. The outlet valve is closed and the priming pump is then activated drawing fluid into the fluid pump. When the fluid pump is filled with fluid the outlet valve is opened. The fluid pump is now primed and is activated to produce full output flow. Once the fluid pump is primed it need not be primed again unless the inlet check valve is opened.

In one embodiment the three essential components are hand or mechanically operated. The outlet valve can be mechanical and turned by hand. The priming pump can also be mechanically operated as with a hand pump. The inlet check valve can be of a spring loaded diaphragm type. These components are easily attached to an already existing non self-priming fluid pump or siphon device thus making it very versatile.

The power used to drive the non self-priming fluid pump whether it be electric, gasoline, diesel or any other source will be considerably less than that required to power a self-priming fluid pump. There is no friction produced by the non self-priming fluid pump as it's impeller does not ride against the inner surface of the fluid pump housing as in self-priming fluid pumps.

Non self-priming pumps of the same size, voltage and capacity as self-priming pumps produce less friction, greater flow of fluid and also increase the lifespan of the power drive source.

In another embodiment the three essential components are integrated into the casting of the fluid pump. These components can be electrically or hydraulically operated. The outlet valve can be an electromechanical solenoid and the inlet check valve can also be electromechanically operated. The priming pump can be of an electrical solenoid diaphragm type.

The fluid pump priming system can be used extensively in industry, agriculture, farming, manufacturing, marine, military or wherever a pump or siphon device is needed. The benefits of its use include cost savings over present day self-priming pumps and the increased performance and lifespan of fluid pumps. Non self-priming pumps are presently used in many applications such as sump pumps, irrigation pumps, swimming pool and pond pumps. Their use is extensive and they all have problems related to their priming. The fluid pump priming system will resolve these problems.

BRIEF DESCRIPTION OF THE DRAWINGS

The accompanying drawings illustrate the invention. In such drawings.

DETAILED DESCRIPTION OF THE PREFERRED EMBODIMENT

Figure 1:
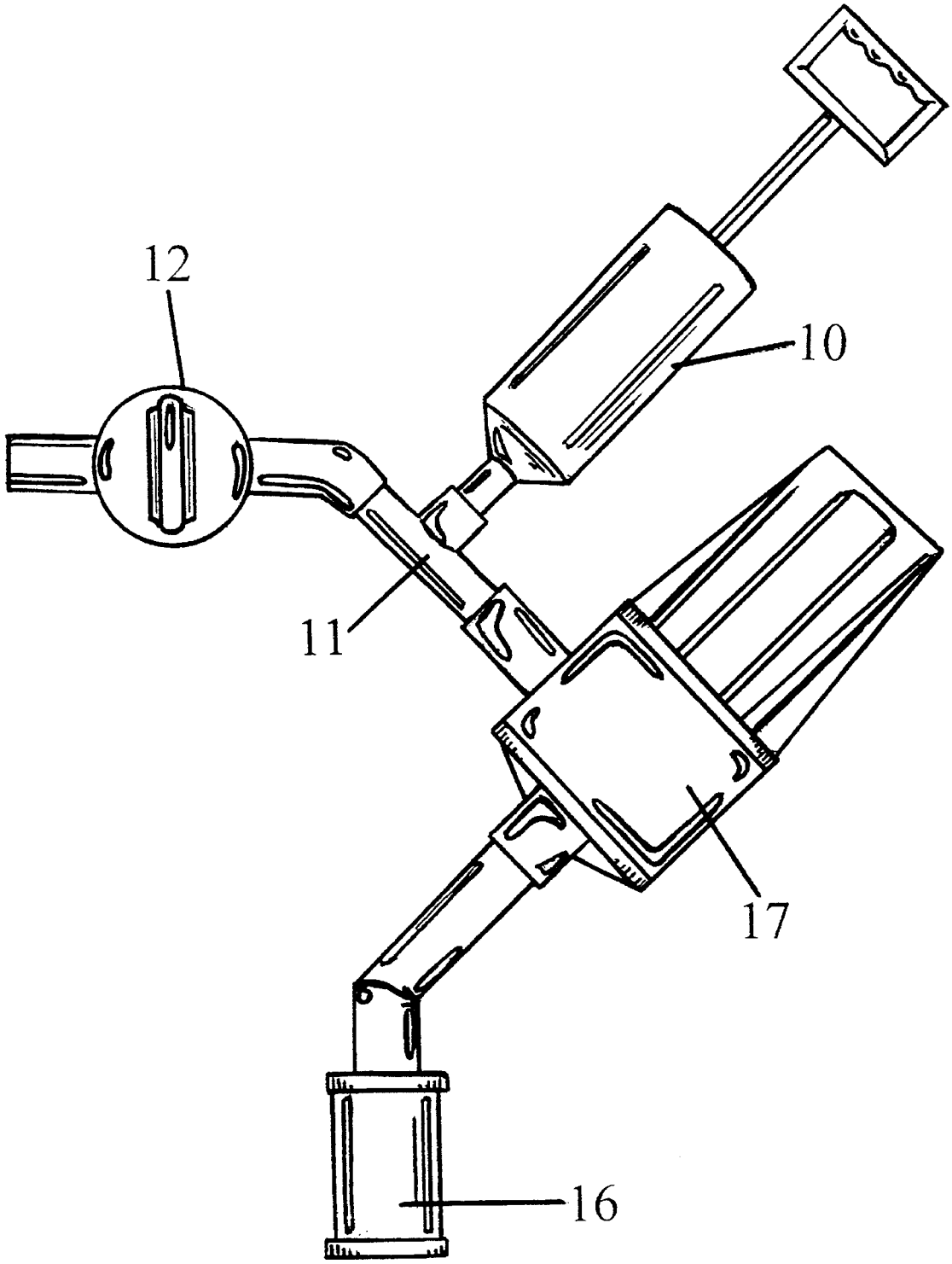
FIG. 1 is a side view of the fluid pump priming system attached to the fluid pump.

FIG. 1 is a side view of the fluid pump priming system. An inlet check valve 16 is attached to the input side of the fluid pump 17. A tee connector 11 has one opening attached to the output side of the fluid pump 17. The remaining two openings are attached to the priming pump 10 and the input side of the outlet valve 12.

Figure 2:
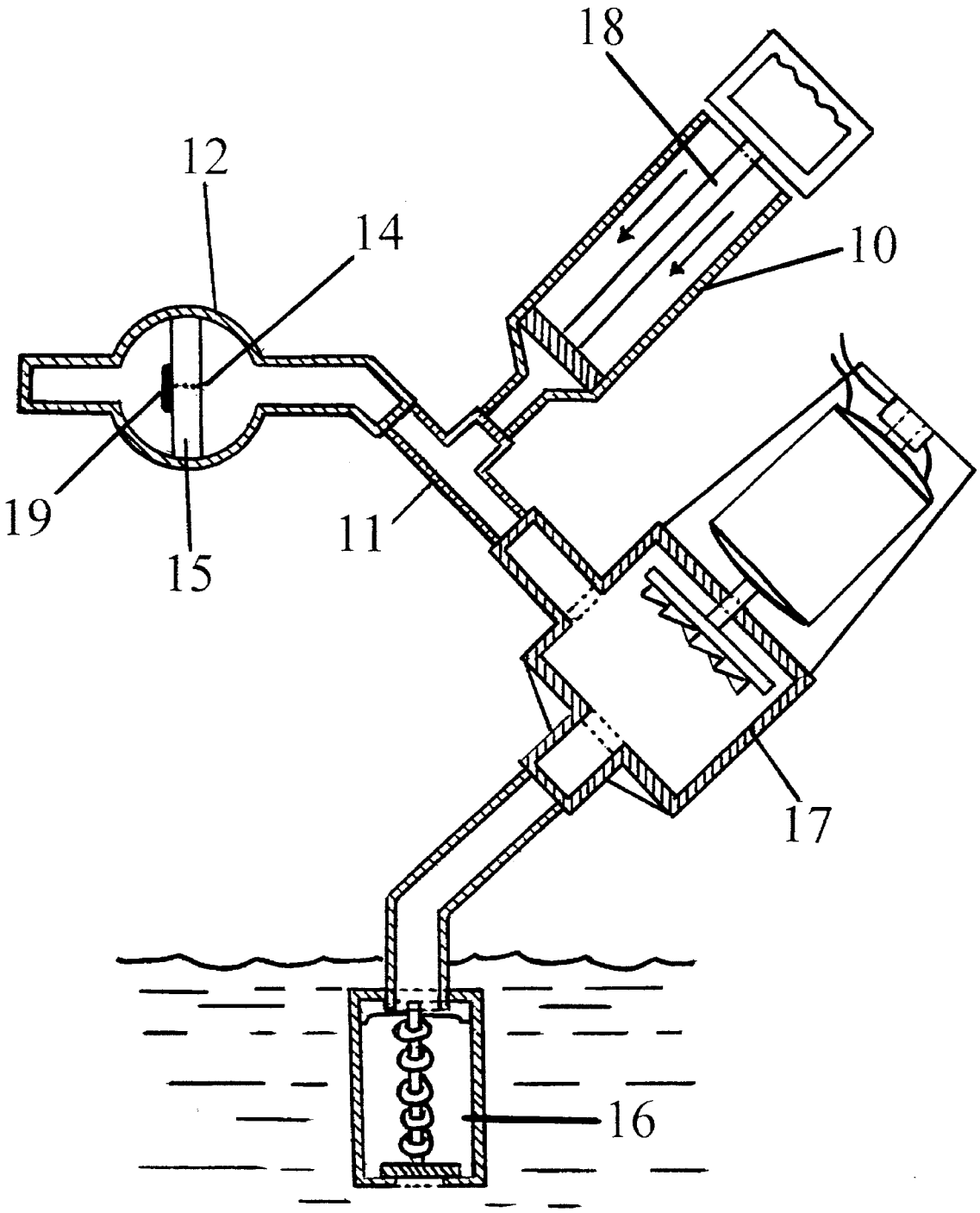
FIGS. 2, 3, 4 and 5 are cut-away side views of the fluid pump priming system attached to the fluid pump.

FIG. 2 is a cut-away side view of the fluid pump priming system attached to a non self-priming fluid pump. The outlet valve plate 15 is perforated with an orifice 14 which is covered by an internal flapper valve 19. The opening and closing of the internal flapper valve 19 over the valve plate orifice 14 is dependant upon the creation of positive air pressure such as compressed air and negative air pressure such as vacuum created by the priming pump 10.

Figure 3:
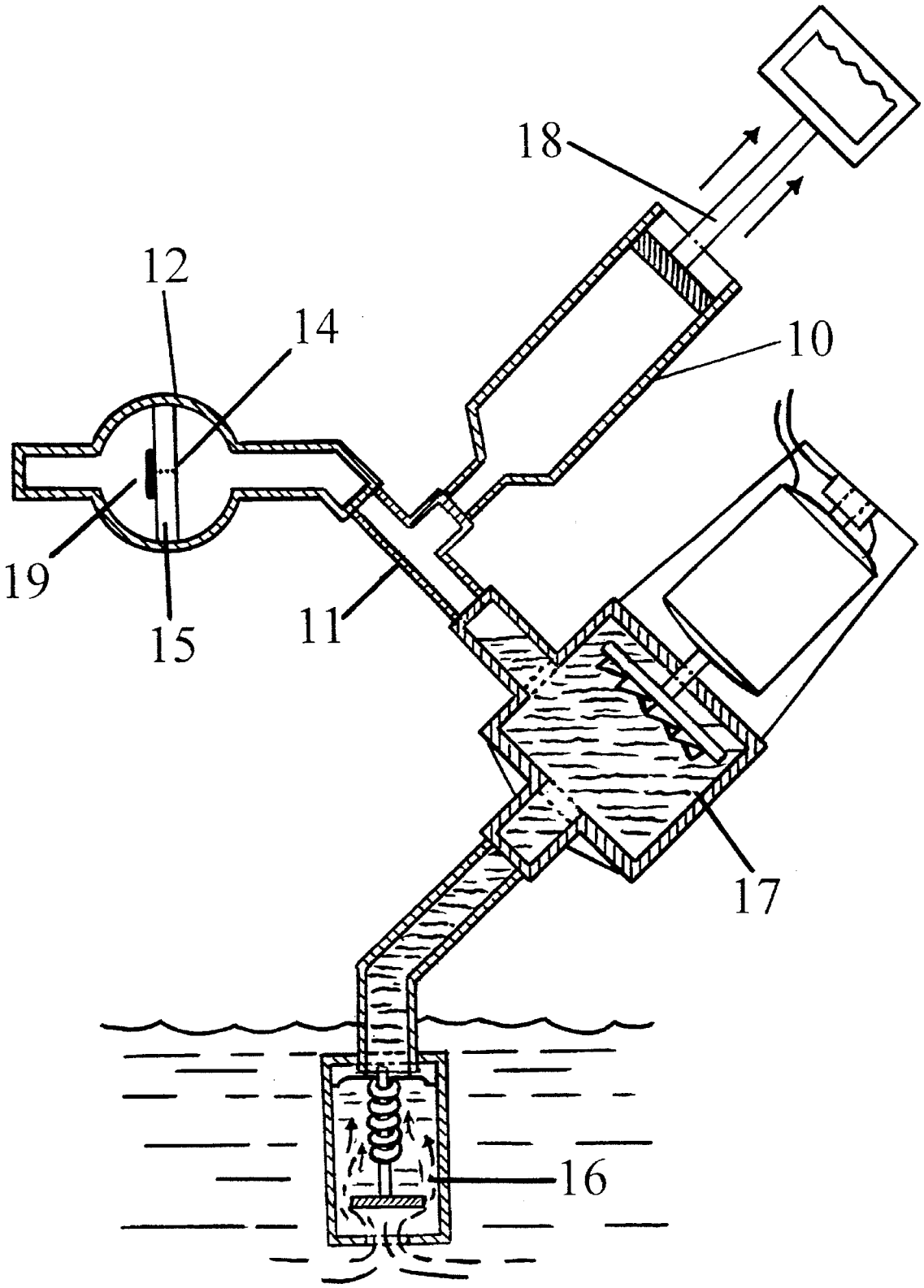

FIG. 3 is a cut-away side view of the fluid pump priming system attached to a non self-priming fluid pump. The priming pump plunger 18 is shown retracted thus creating a vacuum in the fluid pump 17. The vacuum created pulls the internal flapper valve 19 over the valve plate orifice 14 thus closing it and preventing air from entering the fluid pump 17. Simultaneously the vacuum created in the fluid pump 17 pulls open the inlet check valve 16 allowing fluid to enter and pass through the fluid pump 17. The internal flapper valve 19 can be eliminated from the valve plate 15, however performance of vacuum formation is diminished. In another embodiment (not shown) the priming pump is connected to the input side of the fluid pump. The fluid is forced into the fluid pump rather than drawn through the fluid pump as it would be if the priming pump were attached to the outlet side of the fluid pump.

Figure 4:
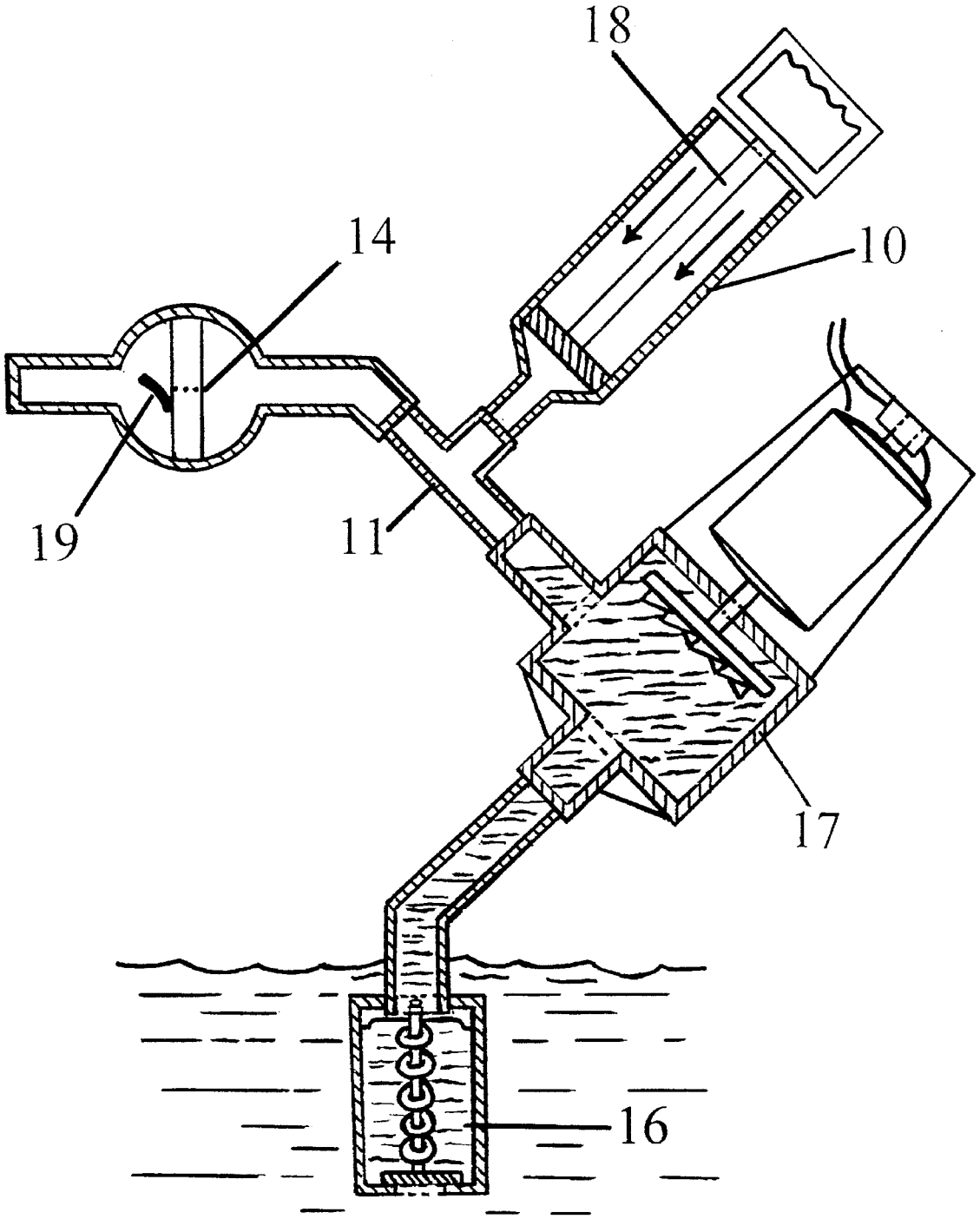

FIG. 4 is a cut-away side view of the fluid pump priming system attached to a non self-priming fluid pump. The priming pump plunger 18 is moved forward in the priming pump 10 thus creating a positive air pressure in the fluid pump 17 and closing the inlet check valve 16 as not to allow backflow of fluid.

The positive air pressure or compressed air formed by this forward motion of the priming pump plunger 18 forces remaining air to be expelled through the valve plate orifice 14 as the internal flapper valve 19 opens. The reciprocating action of the priming pump plunger 18 creates vacuum upon its retraction and draws fluid into and through the fluid pump 17. Upon depression of the priming pump plunger 18 compressed air is eliminated from the fluid pump 17. This reciprocating action of the priming pump plunger 18 is continued until all of the air in the fluid pump 17 is eliminated and only fluid remains. The fluid pump 17 is now primed and ready for use.

Figure 5:
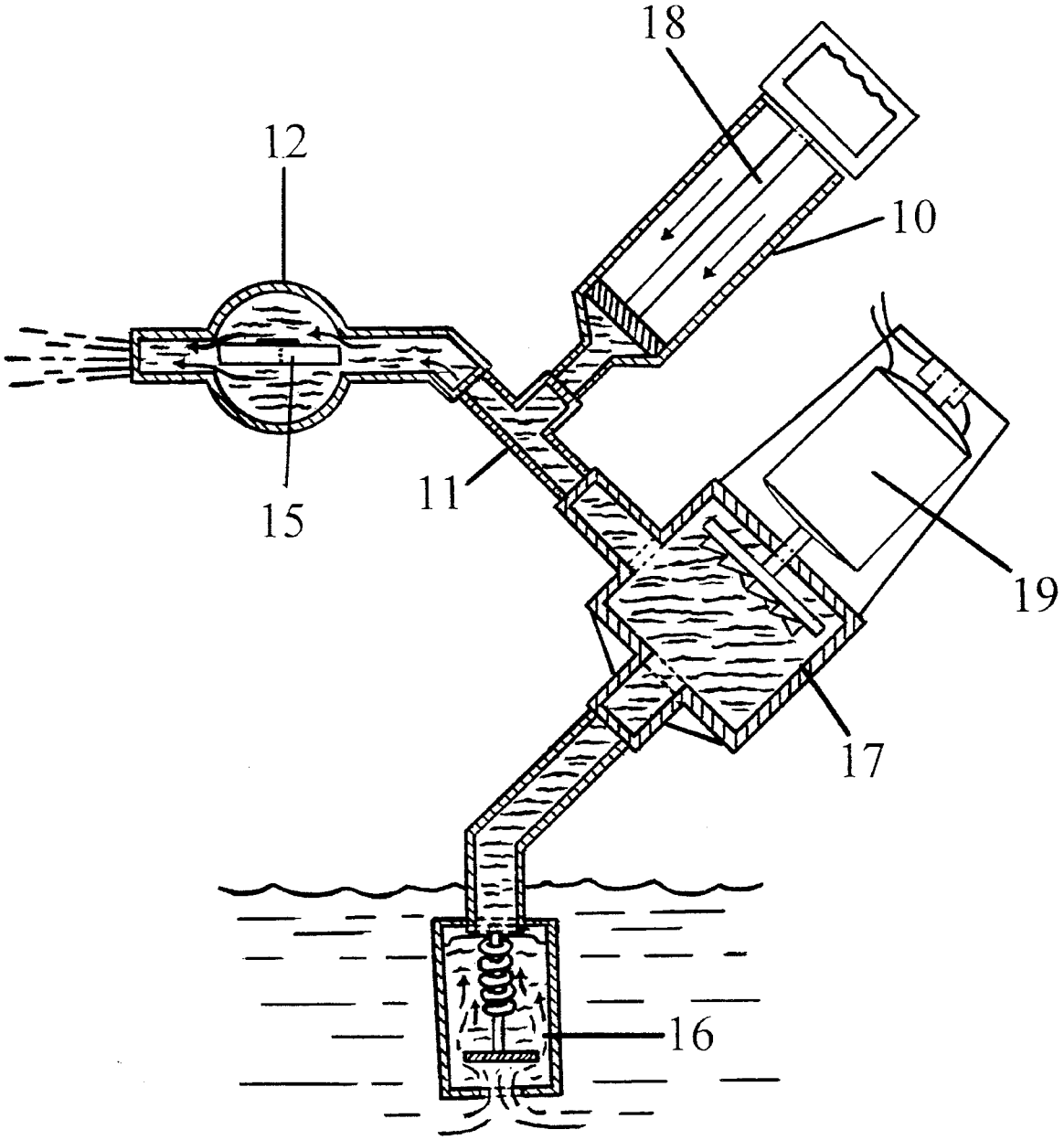
Figure 6C:
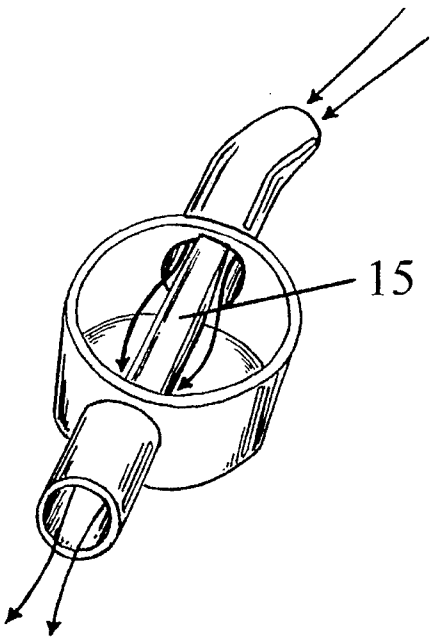
FIG. 6*a*, 6*b* and 6*c* are isometric views of outlet valve with top removed.
Figure 6B:
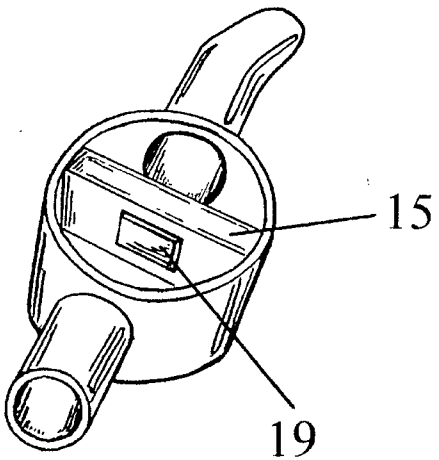
Figure 6A:
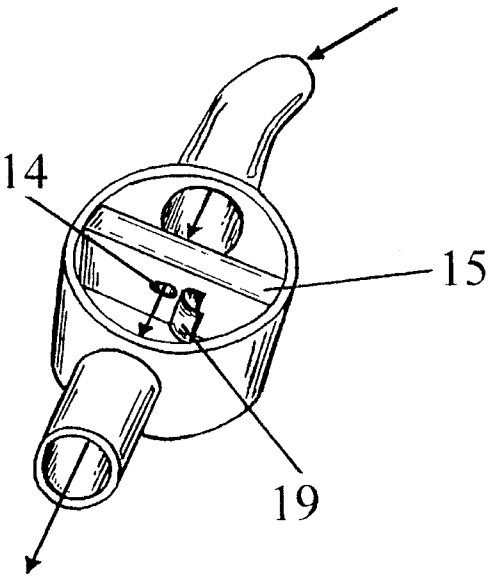

FIG. 5 is a cut-away side view of the fluid pump priming system attached to a non self-priming fluid pump. The fluid pump 17 is now filled with fluid and primed. The outlet valve plate 15 is placed in the open position and the fluid pump drive motor 19 is activated thus drawing the fluid from it's source through the entire system and expelling it through the output side of the outlet valve 12.

Once the fluid pump is primed it need not be primed again unless the inlet check valve is opened, allowing fluid to drain through it and out of the fluid pump.

FIGS. *6a*, *6b* and *6c* are isometric views of the outlet valve with the top removed. FIG. *6a* shows the outlet valve with the valve plate 15 in the closed position. The internal flapper valve 19 is in the open position due to compressed air being forced through the valve plate orifice 14. FIG. *6b* shows the outlet valve with the valve plate 15 in the closed position. The internal flapper valve 19 is held in the closed position due to vacuum formation in the fluid pump. FIG. *6c* shows the outlet valve with the valve plate 15 in the open position thus allowing the fluid to pass through the outlet valve.

Figure 7:
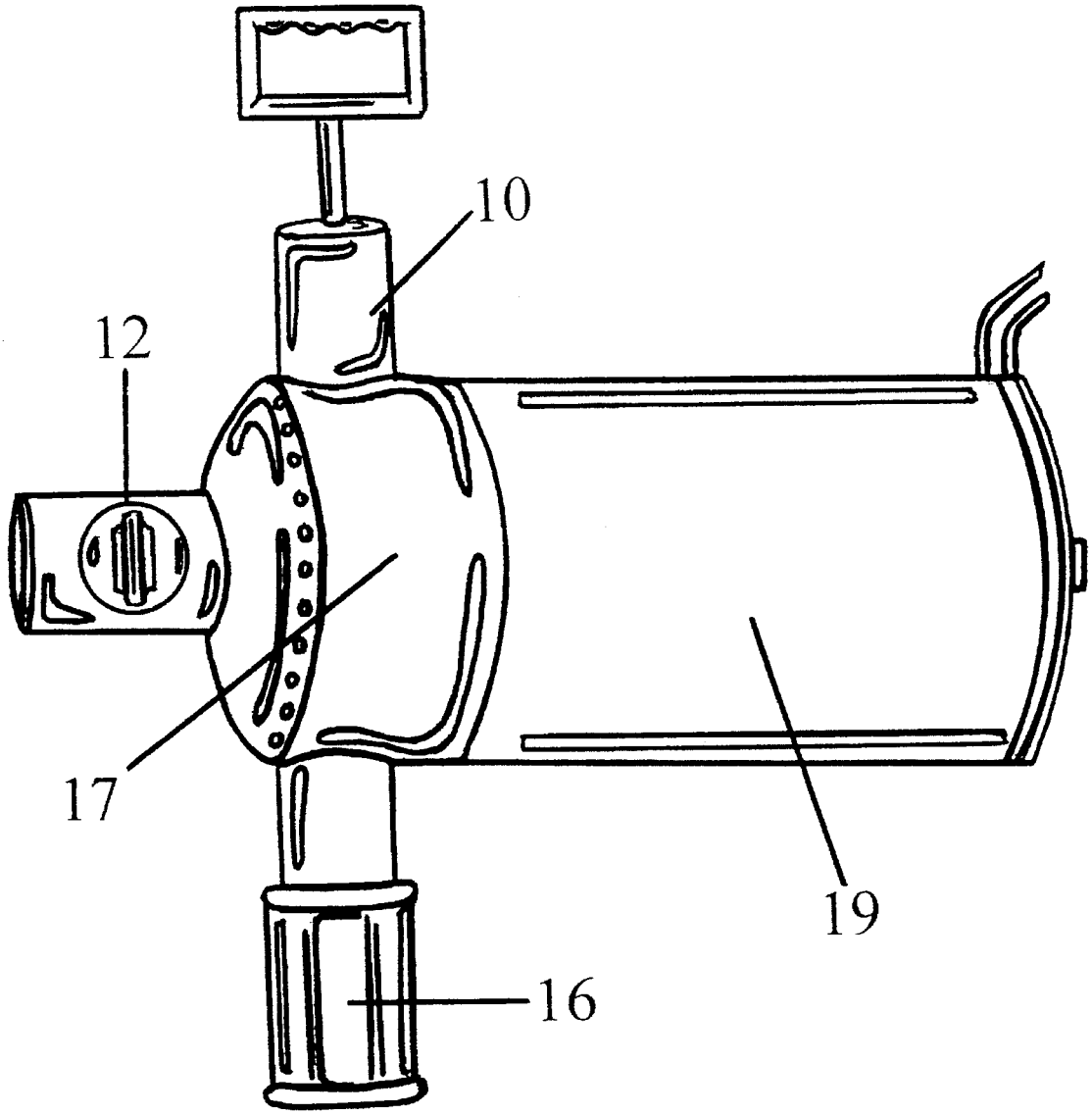
FIG. 7 is a side view of fluid pump priming system cast integrally with fluid pump.

FIG. 7 is a side view of an alternate embodiment of the fluid pump priming system consisting of the three essential components; outlet valve 12, priming pump 10 and inlet check valve 16 all cast integrally with the fluid pump 17. The fluid pump drive source is an electric motor 19.

Figure 8:
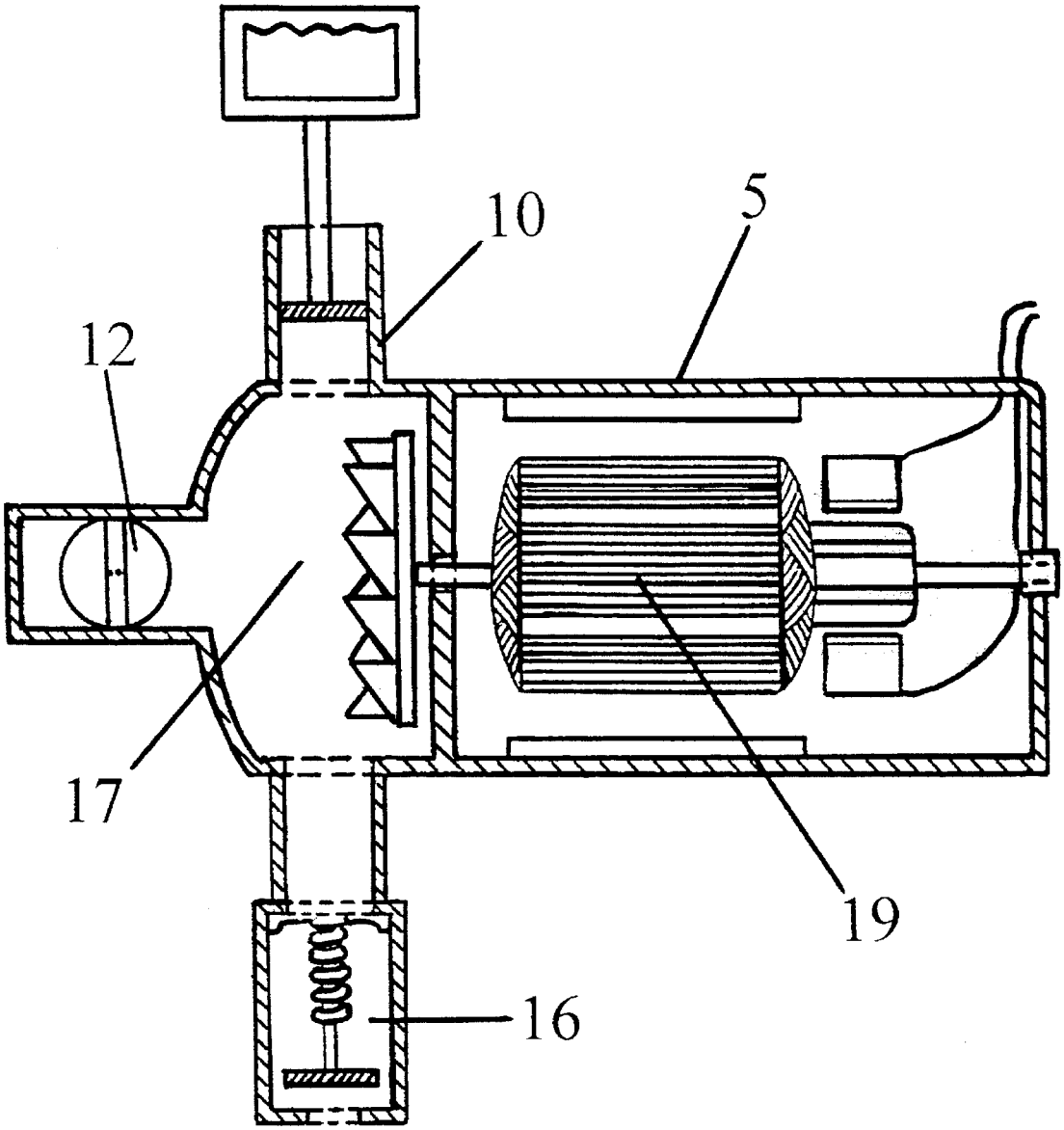
FIG. 8 is a cut-away side view of fluid pump priming system cast integrally with fluid pump.

FIG. 8 is a cut-away side view of the same alternate embodiment of the fluid pump priming system as shown in FIG. 7 showing essential components; outlet valve 12 priming pump 10, inlet check valve 16 and electric motor 19 all cast integrally with the fluid pump 17.

Figure 9:
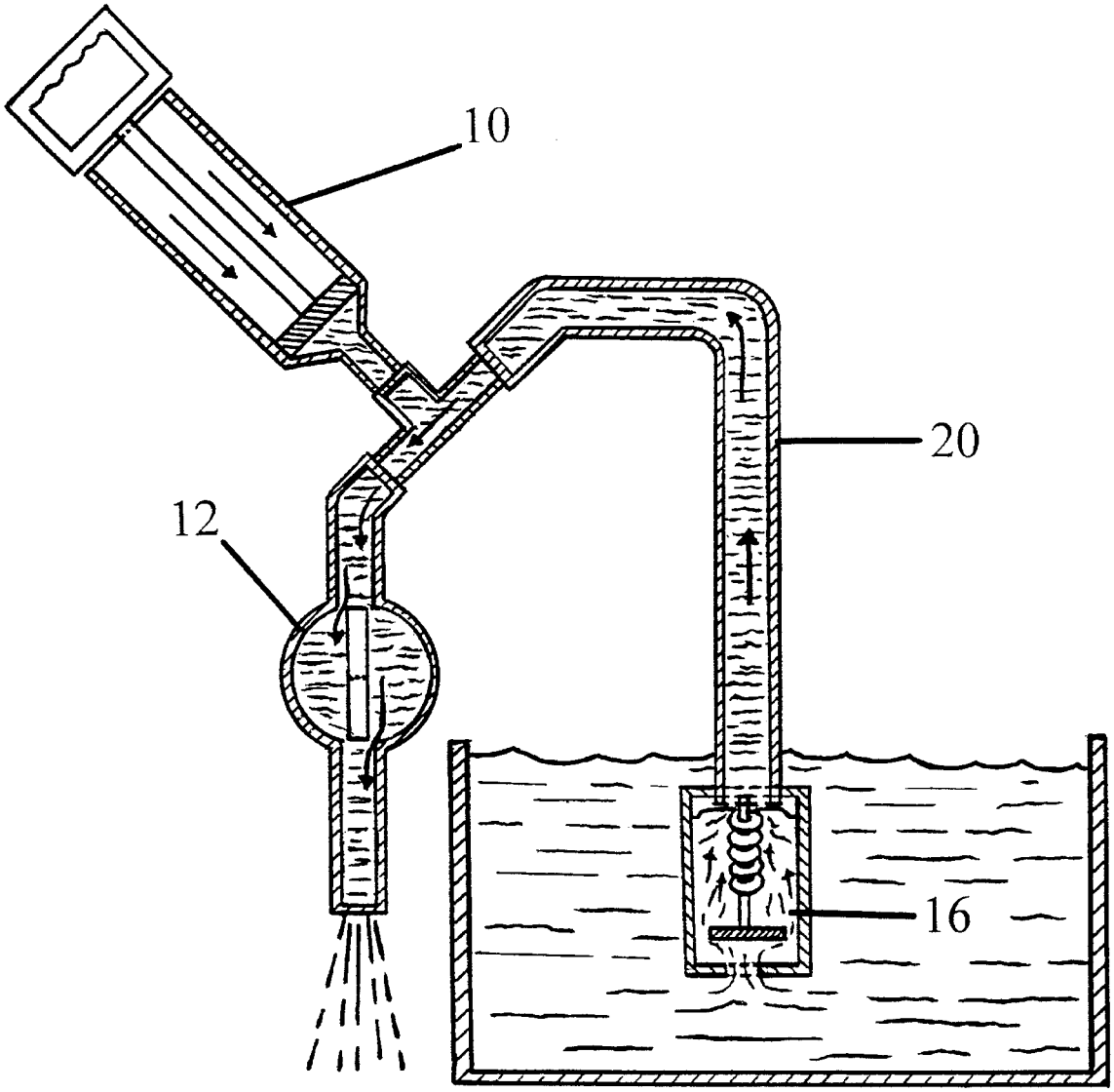
FIG. 9 is a cut-away side view of the fluid pump priming system attached to a fluid siphoning tube.

FIG. 9 is a cut-away side view of the fluid pump priming system attached to a fluid siphoning tube 20 showing essential components: outlet valve 12, priming pump 10 and inlet check valve 16.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not in a limiting sense except by the following claims.

What is claimed is:

1. A fluid pump and siphon device priming system for use with a non self-priming fluid pump or a siphon device comprising:

an outlet valve for dispensing a supply of fluid;

a priming pump for delivering the supply of fluid to said outlet valve, a tube means for carrying the supply of fluid to said outlet valve; wherein said outlet valve includes an internal valve means housed within said outlet valve whereupon the closing of said outlet valve results in the formation of negative air pressure when said internal valve means is closed and further results in the elimination of air when said internal valve means is open.

2. Priming system of claim 1 wherein said priming pump contains means for causing it to produce a positive air pressure and alternately a negative air pressure thus allowing fluid to be drawn into said tube means and fluid pump, upon the presence of negative air pressure, and elimination or air from said tube means and fluid pump upon the presence of positive air pressure.

3. Priming system of claim 1 wherein said tube includes a check valve such that a portion of the supply of fluid always remains in said fluid pump or siphon device after dispensing, to avoid the need for repeated priming of the fluid pump or siphon device.

4. Priming system of claim 3 further comprising a housing for integrally supporting said outlet valve, said priming pump and said check valve.

* * * * *